US006955043B2

(12) United States Patent
Schlossarczyk et al.

(10) Patent No.: US 6,955,043 B2
(45) Date of Patent: Oct. 18, 2005

(54) MUFFLER ASSEMBLY

(75) Inventors: Jörg Schlossarczyk, Winnenden (DE); Georg Maier, Kernen (DE); Tommy Roitsch, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/770,440

(22) Filed: Feb. 4, 2004

(65) Prior Publication Data

US 2004/0154289 A1 Aug. 12, 2004

(30) Foreign Application Priority Data

Feb. 4, 2003 (DE) ..... 103 04 326

(51) Int. Cl.[7] ..... F01N 3/00

(52) U.S. Cl. ..... 60/299; 60/302; 60/312; 60/314; 181/238; 181/240; 181/272

(58) Field of Search ..... 60/299, 302, 312, 60/314; 181/240, 238, 272

(56) References Cited

U.S. PATENT DOCUMENTS 3,650,354 A * 3/1972 Gordon ..... 181/240
4,370,855 A * 2/1983 Tuggle ..... 60/317
4,854,417 A * 8/1989 Uesugi et al. ..... 181/272
5,214,253 A * 5/1993 Houston, Jr. ..... 181/238
5,521,339 A * 5/1996 Despain et al. ..... 181/230
5,857,327 A * 1/1999 Sato et al. ..... 60/302
6,591,606 B2 7/2003 Rosskamp et al.

FOREIGN PATENT DOCUMENTS

DE 3729477 A * 3/1989
JP 06248939 A * 9/1994

* cited by examiner

*Primary Examiner*—Thomas E. Denion
(74) *Attorney, Agent, or Firm*—Walter Ottesen

(57) ABSTRACT

A muffler assembly for an internal combustion engine of a portable handheld work apparatus such as a motor-driven chain saw, cutoff machine or the like includes an exhaust-gas muffler (1) which has a muffler housing (10). The muffler housing (10) is formed essentially from two half shells (24, 25) connected substantially fluid-tight to each other. The interior space of the muffler housing (10) includes at least two chambers (2, 3) which are partitioned from each other by a partition wall (4). A catalytic converter (5) is mounted in the partition wall (4). In the interior space of the muffler housing (10), an exhaust-gas inlet (6) opens which is connected to an exhaust-gas stub (9) of the cylinder (8) of the engine. The exhaust-gas muffler has an exhaust-gas outlet (7) which conducts exhaust gas from the interior space. The exhaust-gas muffler (1) is connected with threaded fasteners at at least three attachment points (22, 23) to the cylinder (8) in order to obtain a good fixation of the exhaust-gas muffler on the cylinder (8) of the engine. At least two attachment points (22) are arranged in the region of the exhaust-gas stub (9).

30 Claims, 7 Drawing Sheets

MUFFLER ASSEMBLY

CROSS REFERENCE TO RELATED APPLICATION

This application claims priority of German patent application no. 103 04 326.8, filed Feb. 4, 2003, the entire content of which is incorporated herein by reference.

1. Field of the Invention

The invention relates to a muffler assembly for an internal combustion engine of a portable handheld work apparatus such as a motor-driven chain saw, cutoff machine or the like.

2. Background of the Invention

U.S. Pat. No. 6,591,606 discloses an exhaust-gas muffler for an internal combustion engine in a portable handheld work apparatus. The inner space of this muffler includes several chambers. Two chambers are partitioned by a partition wall in which a catalytic converter is mounted. Exhaust-gas mufflers of this kind are usually fixed with threaded fasteners on both sides of the exhaust-gas stub of the engine in order to ensure fixation of the exhaust-gas muffler on the engine as well as to ensure a good seal between the exhaust-gas stub and the exhaust-gas muffler. Because of the comparatively high weight of the catalytic converter, the exhaust-gas muffler can be excited to oscillations because of the vibrations of the engine whereby the threaded fasteners on the engine can loosen. In this way, exhaust gas can escape between the exhaust-gas stub and the muffler. This leads to a deterioration of the exhaust-gas values and to an increased development of noise.

SUMMARY OF THE INVENTION

It is an object of the invention to provide a muffler assembly of the kind described above which has a high mechanical stability and ensures a good noise attenuation.

The muffler assembly of the invention is for an internal combustion engine of a portable handheld work apparatus, the engine having a cylinder and an exhaust-gas stub. The muffler assembly includes: an exhaust-gas muffler having a muffler housing including first and second half shells connected substantially fluid tight to each other and the first and second half shells conjointly defining an interior space; the muffler housing further including a partition wall partitioning the interior space into first and second chambers; a catalytic converter mounted in the partition wall; an exhaust-gas inlet opening into the interior space and being connected to the exhaust-gas stub of the engine; an exhaust-gas outlet for conducting exhaust gas out of the interior space; the exhaust-gas muffler and the cylinder conjointly defining three attachment points; three threaded fasteners for fixing the exhaust-gas muffler on the cylinder at corresponding ones of the attachment points; and, first and second ones of the attachment points being disposed in the region of the exhaust-gas stub.

The additional attachment point leads to an improved connection between the exhaust-gas muffler and the cylinder. Two attachment points function to fix the exhaust-gas muffler on the exhaust-gas stub and, in this way, ensure a tight connection. An excitation of the muffler to oscillations is substantially avoided because of at least one additional attachment point.

The exhaust-gas muffler is advantageously attached with a threaded fastener on a cooling rib of the cylinder at the third attachment point. The cooling rib is advantageously thickened for this purpose. A simple configuration results with the fixation to a cooling rib. Advantageously, the two half shells are connected to each other at a peripherally-extending edge with the third attachment point being arranged in the region of the edge. The third attachment point is thereby easily accessible. At the same time, a comparatively large spacing is achieved between the third attachment point arranged at the edge and the two other attachment points arranged on the exhaust-gas stub. In this way, a good fixation of the exhaust-gas muffler is provided. In order to avoid a too intense heating of the exhaust-gas muffler, a heat-protective sheet metal part is arranged between the muffler housing and the cylinder. A good fixation of the exhaust-gas muffler can furthermore be achieved in that the exhaust-gas muffler is supported at at least one support point on a neighboring component, especially on the cylinder. With the support of the muffler on the cylinder, relative movements between the cylinder and other components need not be compensated. An advantageous configuration results when a support point is provided on a recessed point in the heat-protective sheet metal part. The muffler housing is supported on the heat-protective sheet metal part by at least one bracket and the bracket is arranged especially in the region of a recessed portion. With the arrangement of recessed portions and brackets, the stability of the muffler housing is simultaneously increased. A further increase of the stability results when the partition wall, which holds the catalytic converter, has recessed portions and/or is arcuate in shape.

Because of the catalysis in the catalytic converter, the temperatures of the exhaust gas in the catalytic converter increase greatly. In order to prevent an operator from becoming burned by the hot exhaust gas, the exhaust-gas muffler has an air channel delimited by an external hood and the exhaust-gas muffler housing. The air channel extends along a aide of the exhaust-gas muffler. At a first end of the air channel, an air flow enters which again exits at the other, second end of the air channel. The exhaust-gas flow exits into the air channel via the exhaust-gas outlet of the muffler. The hot exhaust gas is cooled by the air flow in the air channel. An improvement of the muffler characteristics of the exhaust-gas muffler is achieved when the exhaust-gas outlet is toned by one or several outlet openings with a resonance tube being arranged forward of each outlet opening in flow direction. The resonance pipe is delimited by a deep-drawn part and the muffler housing wall. A further increase of the stability of the muffler results when the deep-drawn part is connected to the muffler housing, especially on the inner aide of the second half shell having the exhaust-gas outlet.

A spark protective sieve is mounted in flow direction forward of the resonance pipe. A simple manufacture of the exhaust-gas muffler results when a receptacle for the spark-protective sieve is integrated into the deep-drawn part. The receptacle is so configured that the spark-protective sieve is pushed into the deep-drawn part and is fixed in the deep-drawn part by the outer hood.

A simple manufacture of the exhaust-gas muffler is achieved when the outer hood is configured of several parts. The outer hood has at least one ramp at the second end of the air channel in order to achieve a good mixing of the hot exhaust gas with the ambient air and thereby effect a cooling of the hot exhaust gas. The ramp deflects a component flow of the exhaust gas. The exhaust gas thereby flows in at least two directions from the exhaust-gas muffler so that a good mixing with the ambient air and a homogeneous distribution in the ambient air is ensured. Advantageously, at least one ramp is formed by a sheet metal part connected to the outer hood. To achieve a targeted exit direction and therefore a good mixing of the exhaust gas from the exhaust-gas muffler with the air flow, at least one outlet opening from the exhaust-gas muffler is formed at a scoop. To increase the length of the air channel while substantially retaining the structural size of the exhaust-gas muffler, at least one scoop is configured to project from the muffler housing. A simple manufacture is achieved when at least one scoop is configured at a projection fixedly connected to the muffler housing.

In order to achieve a high stability of the exhaust-gas muffler, a corrugated sheet metal part is attached to a smooth wall, especially on the outer hood. The corrugated metal part is especially tox clinched or welded. This light construction is achieved by the combination of a smooth part with a corrugated part and is characterized by low weight, high strength, low body noise and a high thermal insulation.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
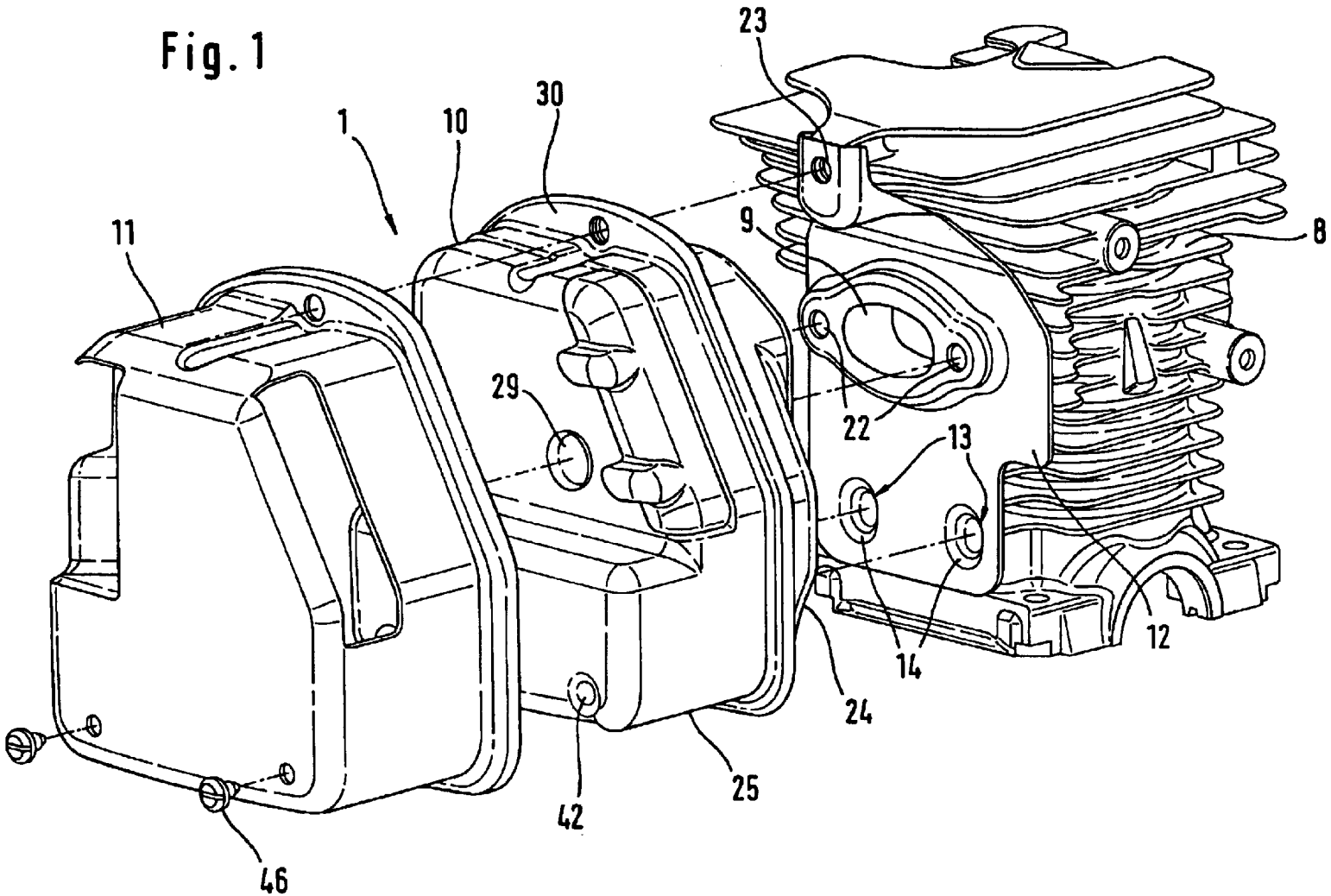
FIG. 1 is a perspective exploded view of a muffler assembly according to the invention.

The muffler assembly shown in FIG. 1 includes an exhaust-gas muffler 1 which is fixed to the cylinder 8 of an internal combustion engine. The exhaust-gas muffler 1 includes a muffler housing 10 which is essentially configured of a first half shell 24 and a second half shell 25. The second half shell 25 is arranged facing away from the cylinder 8 of the internal combustion engine. The exhaust-gas muffler 1 includes an exhaust-gas inlet 6 (FIG. 2), which is connected to the exhaust-gas stub 9 of the cylinder 8. Two attachment points 22 are provided for fixing the exhaust-gas muffler housing 10 on the cylinder 8 of the engine. The two attachment points 22 are arranged on both sides of the exhaust-gas stub 9. The muffler housing 10 is fixedly mounted on the exhaust-gas stub 9 by means of screws. The screws are assembled through two attachment sleeves 29 (see also FIG. 7). A third attachment point 23 is provided in addition to the two attachment points 22. The third attachment point 23 is disposed in the region of the edge 30 of the muffler housing 10 whereat the two half shells 24 and 25 are connected to each other. At the third attachment point 23, the outer hood 11 is also fixed and this outer hood encloses the muffler housing 10 on the side of the muffler housing 10 facing away from the cylinder 8. In addition, the outer hood 11 is fixedly threadably fastened via two screws 46 to the attachment points 42 in the muffler housing 10.

Figure 2:
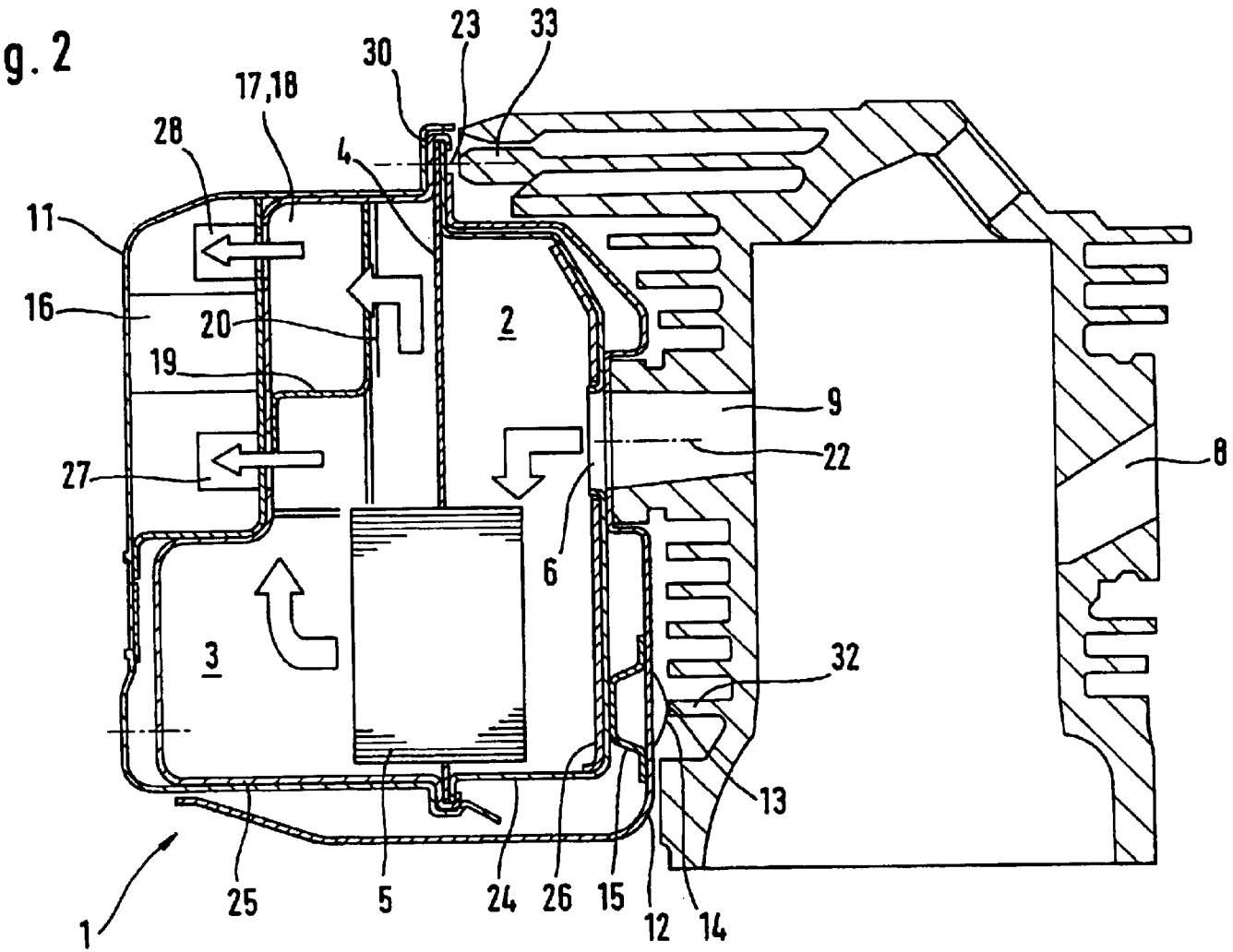
FIG. 2 is a schematic view of a cross section through the muffler assembly.

A heat-protective sheet metal part 12 is arranged between the muffler housing 10 and the cylinder 8. On the end, which lies opposite to the third attachment point 23, the heat-protective sheet metal part 12 has two recessed portions 14 lying against support points 13. As shown in FIG. 2, the heat-protective sheet metal part 12 is supported with the two recessed portions 14 on a cooling rib 32 of the cylinder 8. The recessed portions 14 rise in a direction toward the cooling rib 32. On the side of the heat-protective sheet metal part 12, which faces away from the recessed portions 14, a bracket 15 is arranged with which the first half shell 24 of the muffler housing 10 is supported on the heat-protective sheet metal part 12. As shown in FIG. 2, the muffler housing 10 is fixed tightly at a thickened cooling rib 33 with a screw at the third attachment point 23 in order to thereby ensure an adequate fixation. The heat-protective sheet metal part 12 extends between the exhaust-gas muffler 1 and the cylinder 8 as well as in the region of the side of the exhaust-gas muffler 1 facing toward the crankcase of the engine.

Figure 8:
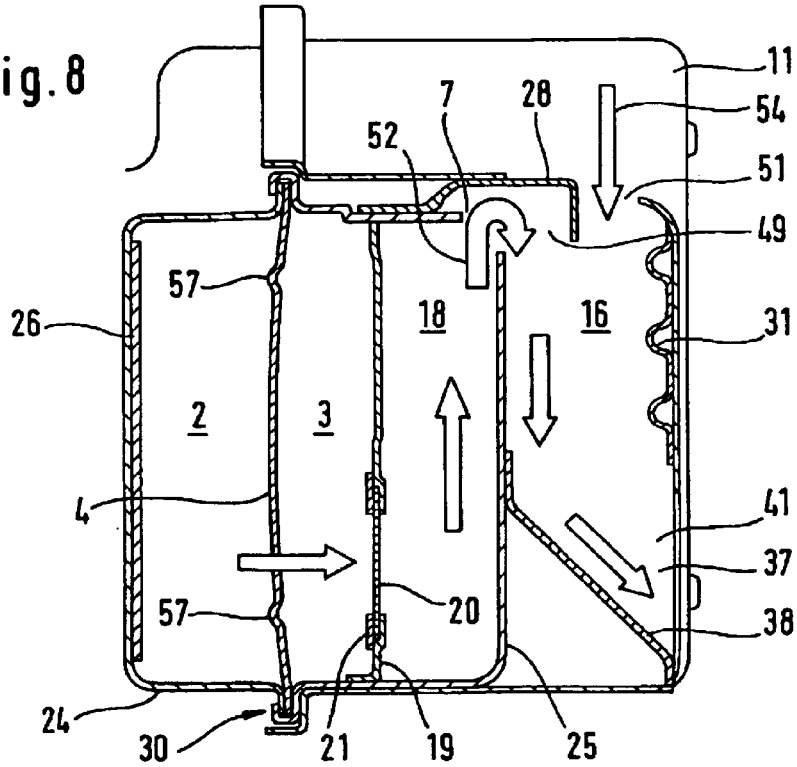
FIG. 8 is a section view taken along line VIII—VIII of FIG. 5.

The two half shells 24 and 25 are connected to each other at the flanged-over edge 30. At the edge 30, a partition wall 4 is fixed which partitions the interior space of the muffler housing 10 into a first chamber 2 and a second chamber 3. A catalytic converter 5 is held in the partition wall 4. As shown in FIG. 8, the partition wall 4 is configured so as to be arcuate. In addition, recessed portions 57 are provided which lead to a further stability of the partition wall 4. It can be practical to provide only an arcuate portion or only recessed portions 57 in the partition wall 4. The first half shell 24 is provided with a reinforcement wall 26 at the side facing toward the cylinder 8 and this reinforcement wall 26 is fixedly connected to the first half shell 24.

During operation of the internal combustion engine, exhaust gas flows from the exhaust-gas stub 9 through the exhaust-gas inlet into the first chamber 2 in the muffler housing 10. From there, the exhaust gas flows through the catalytic converter 5 into the second chamber 3 from where the exhaust gas flows through a spark-protective sieve 20 into resonance tubes 17 and 18. The spark-protective sieve 20 is shown schematically in FIG. 2. The exhaust-gas exits via scoops 27 and 28 from the resonance tubes 17 and 18 into an air channel 16.

In lieu of the two resonance tubes (17, 18) arranged in the flow path, it can be advantageous to provide a common interconnected mixture chamber. The dimensioning of the mixture chamber must be correspondingly adapted.

Figure 3:
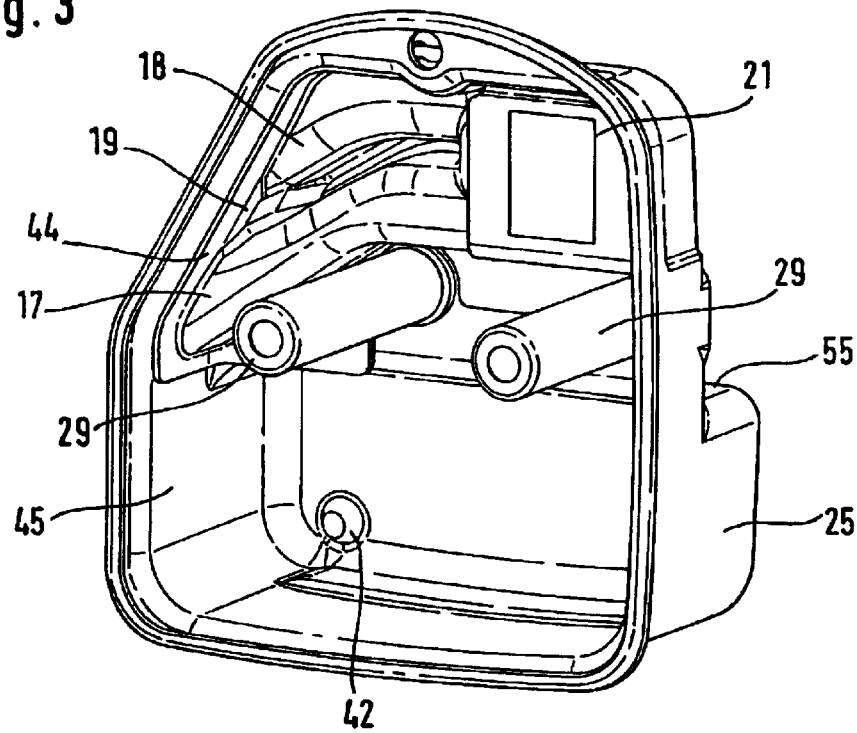
FIG. 3 is a perspective view of the second half shell of the muffler housing.
Figure 4:
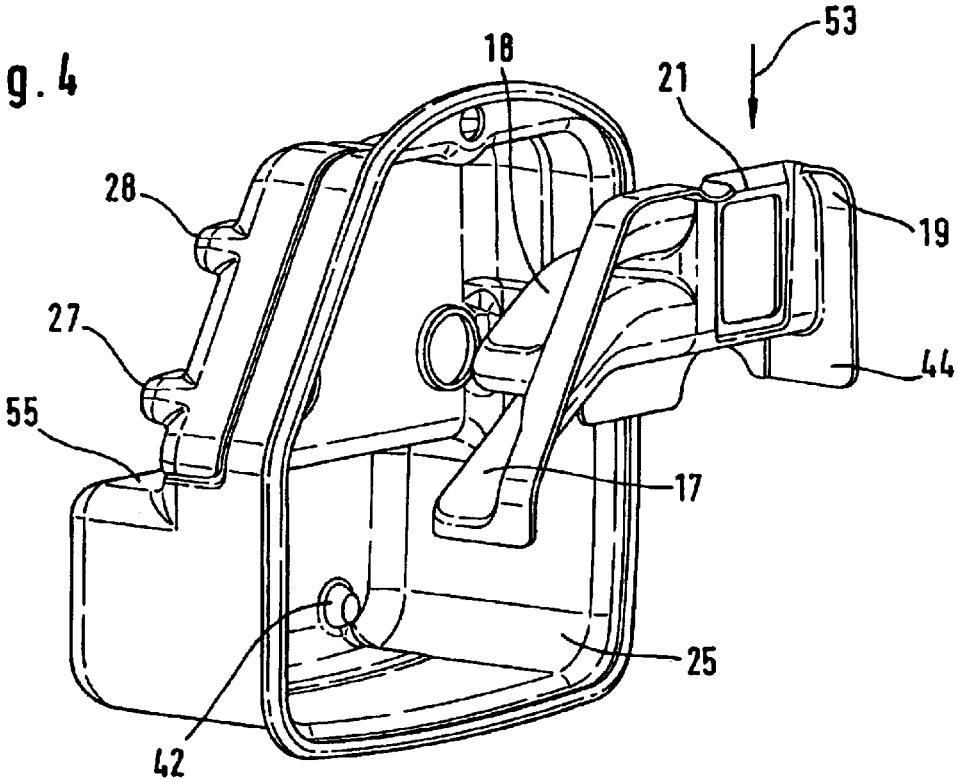
FIG. 4 is another perspective view with an exploded view of the deep-drawn part.
Figure 6:
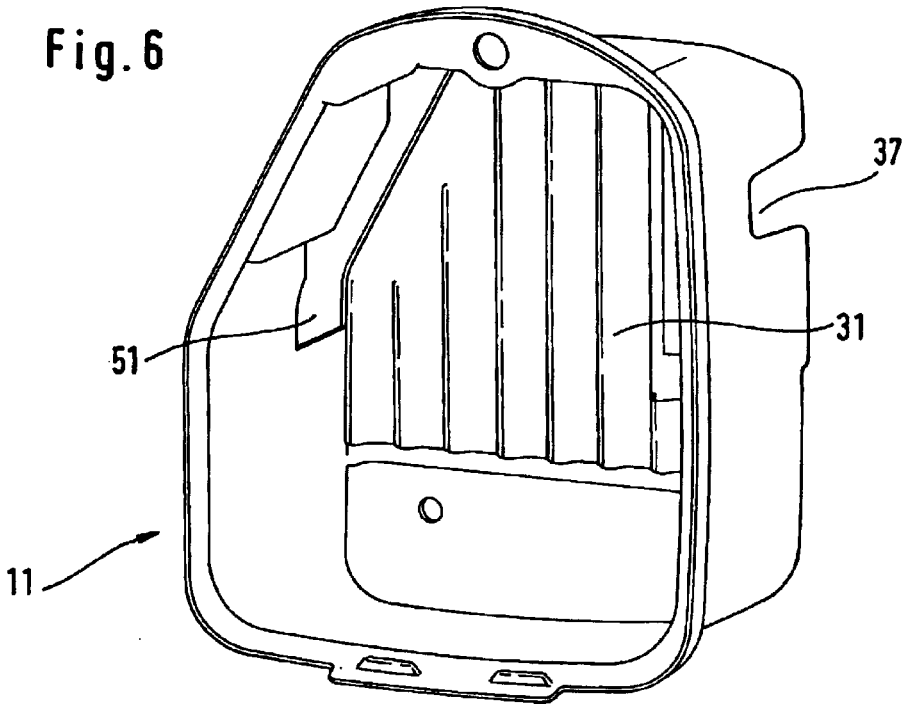
FIG. 6 is a perspective view of the outer hood of the muffler assembly.

As shown in FIGS. 3 and 4, the resonance tubes 17 and 18 are configured in a deep-drawn part 19 and extend essentially parallel to the plane defined by the edge 30. A receptacle 21 is integrated into the deep-drawn part 19 for the spark-protective sieve 20. For assembly, the spark-protective sieve 20 is pushed into the receptacle 21 in the direction of arrow 53 and is fixed by the outer hood 11 (FIG. 6). The spark-protective sieve 20 can be additionally fixed by a screw. Furthermore, a seal can be provided which is pushed into the receptacle 21 with the spark-protective sieve 20 and holds the spark-protective sieve 20 seal-tight in the receptacle 21. The deep-drawn part 19 is fixedly connected at its edge 44 to the wall 45 of the second half shell 25. In this way, an increase of the stiffness of the second half shell 25 results.

Figure 5:
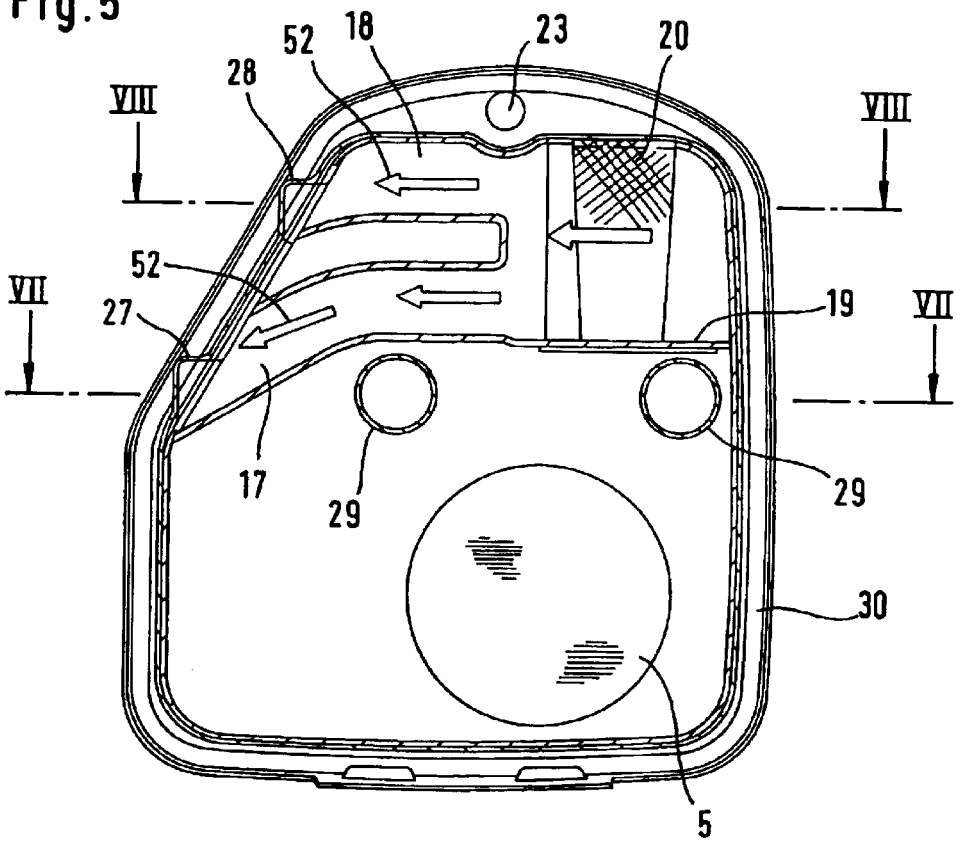
FIG. 5 is a schematic cross section through the muffler housing.
Figure 7:
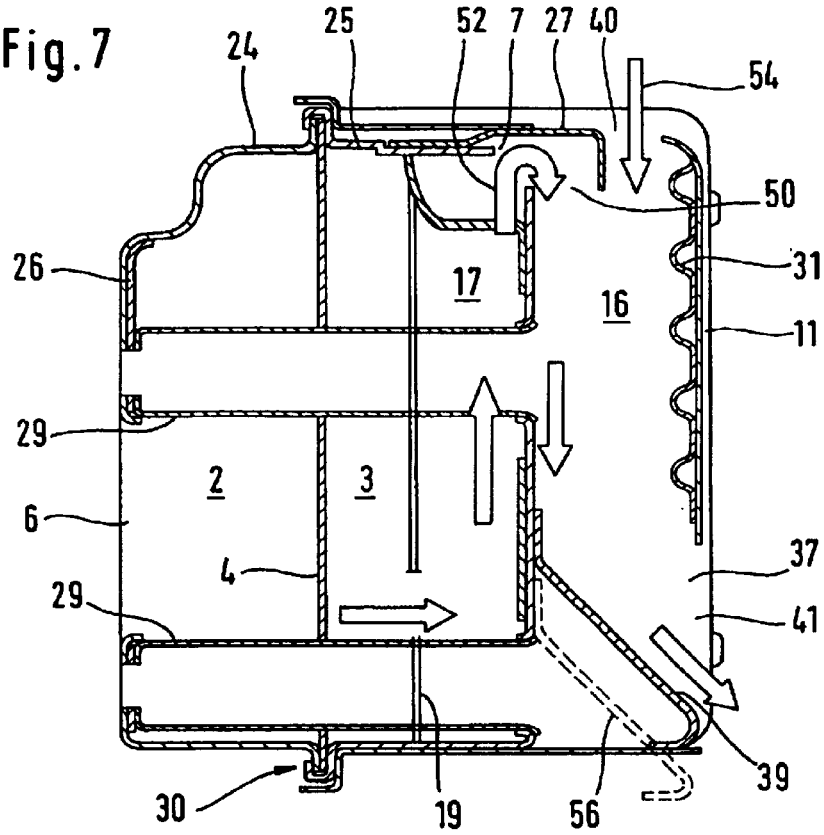
FIG. 7 is a section view taken along line VII—VII of FIG. 5.

The resonance tubes 17 and 18 are shown in FIG. 5. The length of the resonance tube 17 is greater than the length of the resonance tube 18. FIG. 7 shows a section through the resonance tube 17 at the elevation of line VII—VII of FIG. 5. The deep-drawn part 19 is shown schematically. A section through the resonance tube 18 is shown in FIG. 8. The scoops 27 and 28 are arranged downstream of the resonance tubes (17, 18) in the flow direction indicated by arrows 52. In the region of the scoops 27 and 28, an exhaust-gas outlet 7 from the muffler housing 10 is formed. The exhaust-gas outlet 7 is formed by an outlet opening 49 on the resonance tube 18 and an outlet opening 50 on the resonance tube 17. When leaving the muffler housing 10 through the outlet openings 49 and 50, the exhaust gas enters into an air channel 16. The air channel 16 extends over a side of the muffler housing 10. The air channel 16 is formed by the muffler housing 10 and the outer hood 11. In the region of the scoops 27 and 28, the outer hood 11 has an in-flow opening 51 through which air can flow in in the direction of arrow 54 at the first end 40 of the air channel 16. As shown in FIGS. 3 and 4, the second half shell 25 has a step 55 for forming the air channel 16. The air channel 16 has ramps 38 and 39 at the second end 41 (shown in FIGS. 7 and 8). The ramp 38 is arranged opposite scoop 28 while the ramp 39 is arranged in the region of scoop 27. The ramps 38 and 39 effect a deflection of the exhaust-gas flow. At the same time, the sharp abrupt edge, which is formed at each ramp, leads to a fanning of the exhaust-gas flow. The position of the ramps 38 and 39 can be varied and can be adapted to the needed length of the air channel 16. An alternate position of a ramp 56 is indicated by a broken line in FIG. 7.

As also shown in FIG. 6, the outer hood has a corrugated sheet metal part 31 on its inner side, that is, on the side facing toward the muffler housing 10. The corrugated sheet metal part 31 is fixedly connected to the outer hood 11. Advantageously, the corrugated metal part is welded or tox clinched to the outer hood 11, that is, connected thereto by deformation. The corrugated metal part 31 can, however, be fixed to the side, that is, the outer side, of the outer hood 11 with this side facing away from the muffler housing 10. In this way, a smooth inner wall of the outer hood 11 can be achieved with high strength so that, for example, the adherence of chips on the inner wall is avoided. It can be practical to fix a corrugated sheet metal part also to other smooth walls of the exhaust-gas muffler 1 for generating a hollow chamber structure in a light-weight construction. With the formed hollow chamber construction, there results an increased strength of the outer hood 11. The outer hood 11 has an in-flow opening 51 in the region of the scoops 27 and 28 and, on the opposite-lying side, the outer hood 11 has the opening 37 at which the exhaust gas flows out of the air channel 16.

Figure 10:
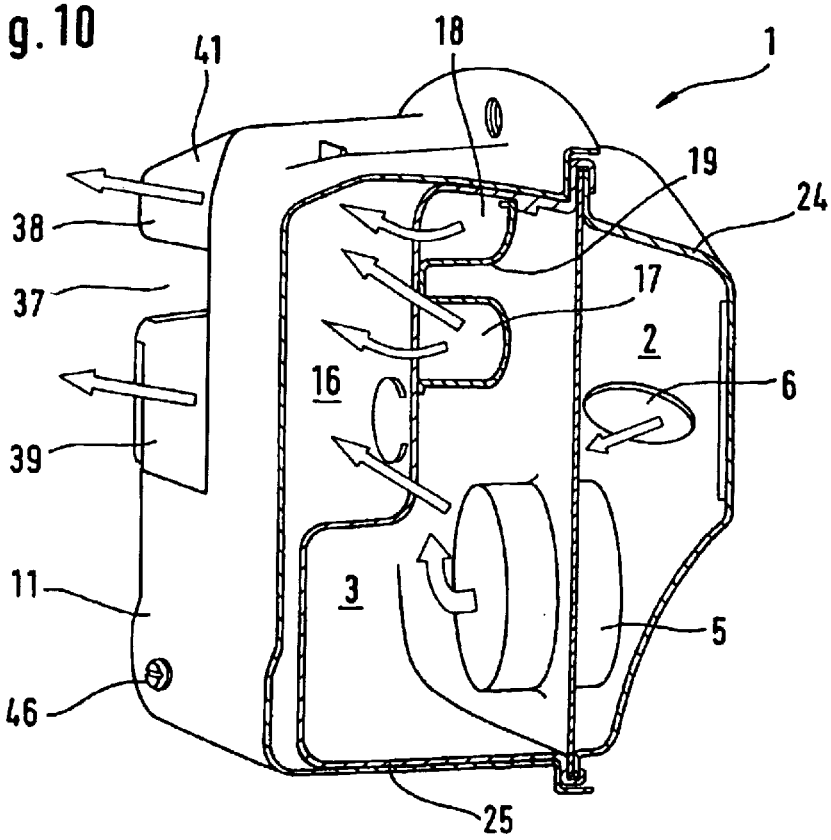
FIG. 10 is a schematic representation of a section through the exhaust-gas muffler.

FIG. 10 shows a schematic cross section through the exhaust-gas muffler 1. The exhaust gas flows through the exhaust-gas inlet 6 into the first chamber 2 which is formed in the first half shell 24. From there, the exhaust gas flows through the catalytic converter 5 into the second chamber 3 and through the spark-protective sieve 20 (not shown in FIG. 10) into the resonance tubes 17 and 18 which are configured in the deep-drawn part 19. The exhaust gas exits from the resonance tubes 17 and 18 through the exhaust-gas outlet 7 (FIGS. 7 and 8) into the air channel 16 where the exhaust gas is mixed with an air flow. The air flow is branched from the ambient air. The air flow has a low dirt content so that the catching and subsequent burn-off of dirt, for example chips, is avoided. Ramps 38 and 39 are provided at the opening 37 lying opposite corresponding ones of the scoops 27 and 28. The ramps 38 and 39 deflect the exhaust gas flow. The exhaust gas leaves the air channel 16 in a straight line between the ramps 38 and 39.

Figure 9:
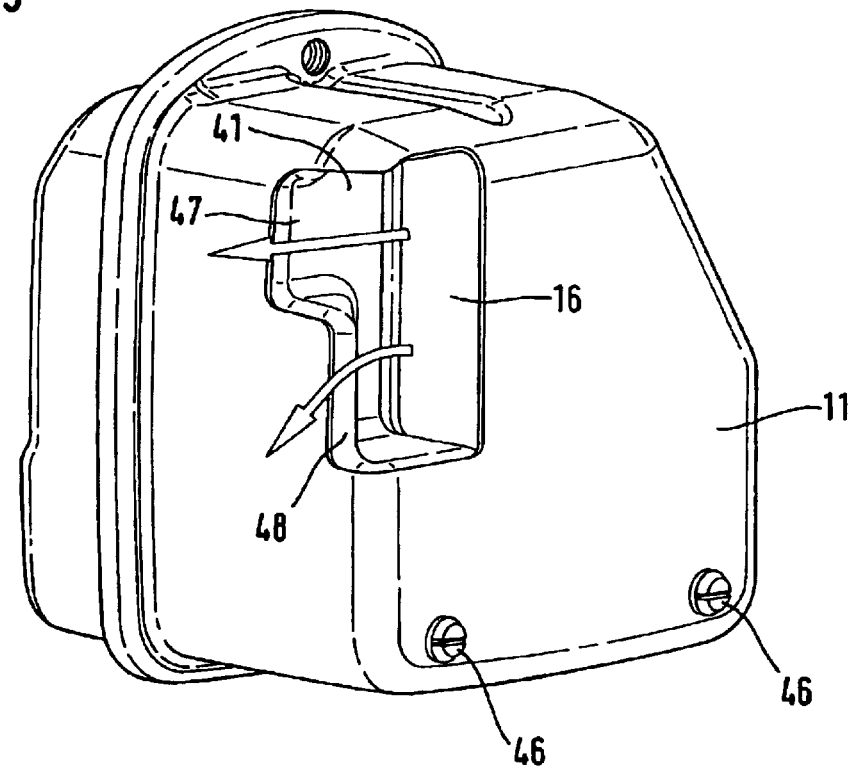
FIG. 9 is a perspective view of the exhaust-gas muffler.

In FIG. 9, an embodiment is shown for the configuration of the second end 41 of the air channel 16. The air channel 16 has an opening 47 wherein a ramp 48 is mounted. The jet of exhaust gas is deflected in the region of the ramp 48 while the jet exits approximately in a straight line from the air channel 16 in the adjacent region.

Figure 11:
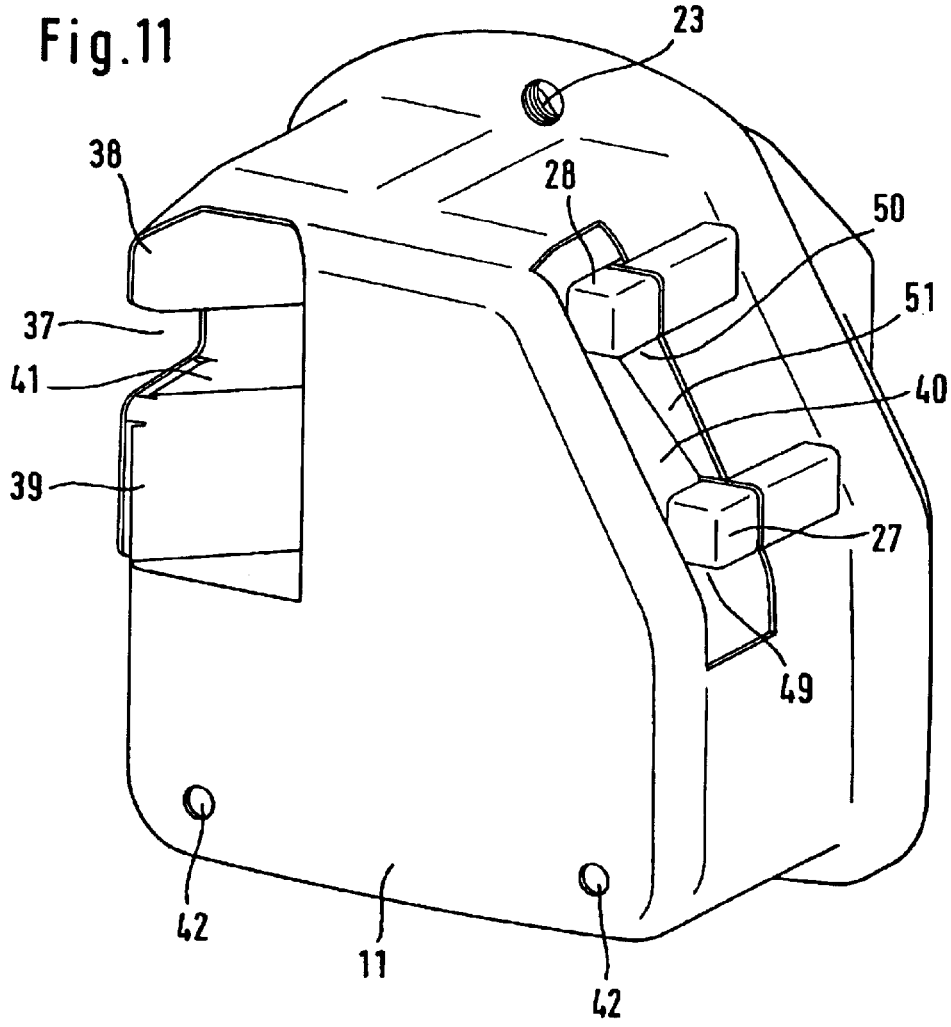
FIG. 11 is a perspective view of the exhaust-gas muffler.
Figure 12:
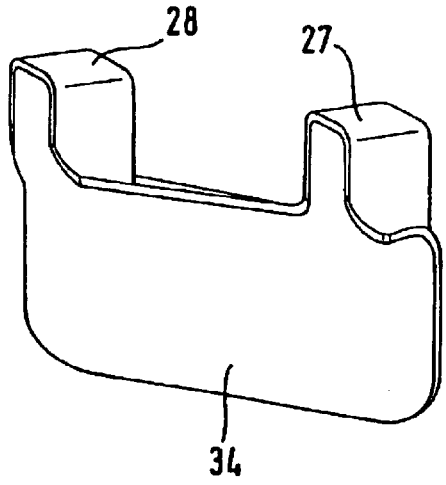
FIG. 12 is a perspective view showing a one-part cap on the outer hood; and, FIG. 13 is a perspective view of a two-part cap.
Figure 13:
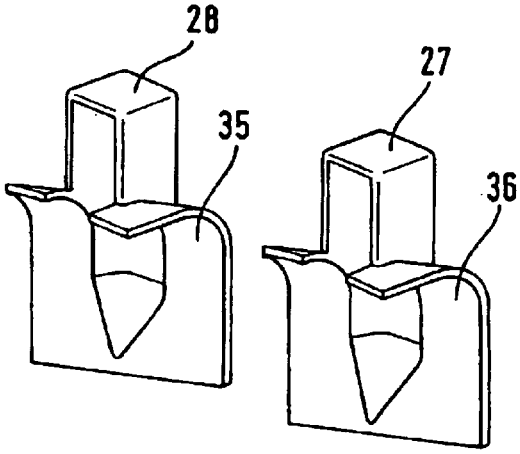

FIGS. 11 to 13 show embodiments for the configuration of the scoops 27 and 28. In order to achieve the largest length of the air channel 16 possible, the scoops 27 and 28 project out of the outer hood 11 in the longitudinal direction of the air channel 16. The scoops 27 and 28 form the outlet openings 49 and 50, respectively, and are surrounded by the in-flow opening 51 at the first end 40 of the air channel 16. The scoops 27 and 28 can be formed by a cap 34 as shown in FIG. 12 with both scoops 27 and 28 being formed on the cap 34. The scoops (27, 28) are each fixed to the muffler housing 10 and project into the in-flow opening 51 in the outer hood 11. The cap 34 is connected to the second half shell 25 in the region of the exhaust-gas outlet 7. In lieu thereof, the separate caps 35 and 36 shown in FIG. 13 can be connected to the second half shell 25 with each of the caps 35 and 36 forming a scoop. The use of two separate scoops makes possible a simple compensation of manufacturing tolerances. The caps (34, 35, 36) are formed as deep-drawn parts.

The formation of the exhaust-gas muffler 1 from several thin-walled shells connected to each other (in accordance with the light-weight principle) leads to a hollow chamber structure which ensures a low weight of the exhaust-gas muffler 1. The wall thickness of the exhaust-gas muffler 1 can be reduced especially because of the corrugated sheet metal part 31 mounted in the outer hood 11.

It can be practical to provide another number of scoops with a corresponding number of resonance tubes. It can be practical to provide additional attachment points, which are especially arranged on the cylinder, in order to provide a good fixation of the exhaust-gas muffler on the cylinder.

It is understood that the foregoing description is that of the preferred embodiments of the invention and that various changes and modifications may be made thereto without departing from the spirit and scope of the invention as defined in the appended claims.

What is claimed is:

1. A muffler assembly for an internal combustion engine of a portable handheld work apparatus, the engine having a cylinder and an exhaust-gas stub and the muffler assembly comprising:

an exhaust-gas muffler having a muffler housing including first and second half shells connected substantially fluid tight to each other and said first and second half shells conjointly defining an interior space;

said muffler housing further including a partition wall partitioning said interior space into first and second chambers;

an exhaust-gas inlet opening into said interior space and being connected to said exhaust-gas stub of said engine;

an exhaust-gas outlet for conducting exhaust gas out of said interior space, wherein said exhaust-gas outlet is defined by a plurality of outlet openings; and, wherein said exhaust-gas muffler includes a plurality of resonance tubes disposed forward of corresponding ones of said outlet openings as seen in flow direction of the exhaust gas.

2. The muffler assembly of claim 1, wherein said muffler assembly further comprises three threaded fasteners;

wherein said exhaust-gas muffler and said cylinder conjointly define three attachment points;

wherein said exhaust-gas muffler is fixed on said cylinder at corresponding ones of said attachment points via said three threaded fasteners; and, wherein first and second ones of said attachment points are disposed in the region of said exhaust-gas stub.

3. The muffler assembly of claim 2, wherein said cylinder of said engine includes a cooling rib; and, the third one of said attachment points is located at said cooling rib.

4. The muffler assembly of claim 3, wherein said first and second half shells conjointly define a peripherally extending edge whereat said first and second half shells are connected to each other; and, said third attachment point is located in the region of said peripherally extending edge.

5. The muffler assembly of claim 4, said muffler assembly further comprising a heat-protective sheet metal part mounted between said muffler housing and said cylinder.

6. The muffler assembly of claim 5, wherein said cylinder defines a support point and said muffler housing is supported against said support point.

7. The muffler assembly of claim 6, wherein said heat-protective sheet metal part has a recessed portion formed therein and said support point is located at said recessed portion.

8. The muffler assembly of claim 7, wherein said heat-protective sheet metal part has a bracket formed thereon for supporting said muffler housing.

9. The muffler assembly of claim 8, wherein said bracket is mounted on said heat-protective sheet metal part in the region of said recessed portion.

10. The muffler assembly of claim 1, wherein a catalytic converter is mounted in said partition wall; and, wherein said partition wall has an arcuate shape.

11. The muffler assembly of claim 10, wherein said partition wall includes a plurality of recessed portions.

12. The muffler assembly of claim 1, wherein said partition wall includes a plurality of recessed portions.

13. The muffler assembly of claim 1, said exhaust-gas muffler including an outer hood over said muffler housing and said outer hood and said muffler housing conjointly delimiting an air channel extending along one side of said exhaust-gas muffler; said air channel having a first end whereat an airflow enters and a second end whereat said airflow exits; and, said exhaust-gas muffler having said exhaust-gas outlet whereat the exhaust-gas jet exits into said air channel.

14. The muffler assembly of claim 1, said exhaust-gas muffler housing including a deep-drawn part mounted therein and the wall of said exhaust-gas muffler housing and said deep-drawn part conjointly defining said resonance tubes.

15. The muffler assembly of claim 14, wherein said exhaust-gas outlet is disposed in said second half shell and said deep-drawn part is mounted on the inner side of said second half shell.

16. The muffler assembly of claim 15, said exhaust-gas muffler further including a spark-protective sieve mounted forward of said resonance tubes as viewed in the flow direction of said exhaust gas.

17. The muffler assembly of claim 16, wherein said deep-drawn part includes a receptacle for said spark-protective sieve.

18. The muffler assembly of claim 13, wherein said outer hood is made up of a plurality of parts.

19. The muffler assembly of claim 13, wherein said outer hood includes a ramp at said second end of said air channel for deflecting a component flow of said exhaust gas.

20. The muffler assembly of claim 13, wherein said outer hood has a smooth surface and said muffler assembly further comprises a corrugated sheet-metal part attached to said smooth surface.

21. The muffler assembly of claim 1, wherein at least one of said plurality of resonance tubes is longer than a second one of said plurality of resonance tubes.

22. The muffler assembly of claim 4, wherein said plurality of resonance tubes extends essentially parallel to the plane defined by said peripherally extending edge.

23. The muffler assembly of claim 20, wherein said corrugated sheet-metal part is welded to said outer hood.

24. The muffler assembly of claim 20, wherein said corrugated sheet-metal part is tox clinched to said outer hood.

25. A muffler assembly for an internal combustion engine of a portable handheld work apparatus, the engine having a cylinder and an exhaust-gas stub and the muffler assembly comprising:

an exhaust-gas muffler having a muffler housing including first and second half shells connected substantially fluid tight to each other and said first and second half shells conjointly defining an interior space;

said muffler housing further including a partition wall partitioning said interior space into first and second chambers;

a catalytic converter mounted in said partition wall;

an exhaust-gas inlet opening into said interior space and being connected to said exhaust-gas stub of said engine;

an exhaust-gas outlet for conducting exhaust gas out of said interior space;

said exhaust-gas muffler and said cylinder conjointly defining three attachment points;

three threaded fasteners for fixing said exhaust-gas muffler on said cylinder at corresponding ones of said attachment points;

first and second ones of said attachment points being disposed in the region of said exhaust-gas stub;

said exhaust-gaps muffler including an outer hood over said muffler housing and said outer hood and said muffler housing conjointly delimiting an air channel extending along one side of said exhaust-gas muffler; said air channel having a first end whereat an airflow enters and a second end whereat said airflow exits; and, said exhaust-gas muffler having said exhaust-gas outlet whereat the exhaust-gas jet exits into said air channel, wherein said exhaust-gas outlet is defined by a plurality of outlet openings; and, said exhaust-gas muffler includes a plurality of resonance tubes disposed forward of corresponding ones of said outlet openings as seen in flow direction of the exhaust gas, and, wherein at least one of said outlet openings is configured on a scoop.

26. The muffler assembly of claim 25, wherein said scoop is configured so as to project from said muffler housing.

27. The muffler assembly of claim 26, wherein said muffler housing has a projection fixedly mounted thereon and said scoop is formed on said projection.

28. A muffler assembly for an internal combustion engine of portable handheld work apparatus, the engine having a cylinder and an exhaust-gas stub and the muffler assembly comprising;

an exhaust-gas muffler having a muffler housing including first and second half shells connected substantially fluid tight to each other and said first and second half shells conjointly defining an interior space;

said muffler housing further including a partition wall partitioning said interior space into first and second chambers;

a catalytic converter mounted in said partition wall;

an exhaust-gas inlet opening into said interior space and being connected to said exhaust-gas stub of said engine;

an exhaust-gas outlet for conducting exhaust gas out of said interior space;

said exhaust-gas muffler and said cylinder conjointly defining three attachment points;

three threaded fasteners for fixing said exhaust-gas muffler on said cylinder at corresponding ones of said attachment points;

first and second ones of said attachment points being disposed in the region of said exhaust-gas stub;

said exhaust-gas muffler including an outer hood over said muffler housing and said outer hood and said muffler housing conjointly delimiting an air channel extending along one side of said exhaust-gas muffler; said air channel having a first end whereat an airflow enters and a second end whereat said airflow exits; and, said exhaust-gas muffler having said exhaust-gas outlet whereat the exhaust-gas jet exits into said air channel, wherein said outer hood has a smooth surface and said muffler assembly further comprises a corrugated sheet-metal part attached to said smooth surface, and wherein said corrugated sheet-metal part is welded to said outer hood.

29. A muffler assembly for an internal combustion engine of a portable handheld work apparatus, the engine having a cylinder and an exhaust-gas stub and the muffler assembly comprising;

an exhaust-gas muffler having a muffler housing including, first and second half shells connected substantially fluid tight to each other and said first and second half shells conjointly defining an interior space;

said muffler housing further including a partition wall partitioning said interior space into first and second chambers a catalytic converter mounted in said partition wall;

an exhaust-gas inlet opening into said interior space and being connected to said exhaust-gas stub of said engine;

an exhaust-gas outlet for conducting exhaust-gas out of said interior space;

said exhaust-gas muffler and said cylinder conjointly definite three attachment points;

three threaded fasteners for fixing said exhaust-gas muffler on said cylinder at corresponding ones of said attachment points;

first and second ones of said attachment points being disposed in the region of said exhaust-gas stub;

said exhaust-gas muffler including an outer hood over said muffler housing and said outer hood and said muffler housing conjointly delimiting an air channel extending along one side of said exhaust-gas muffler; said air channel having a first end whereat an airflow enters and a second end whereat said airflow exits; and, exhaust-gas muffler having said exhaust-gas outlet whereat the exhaust-gas jet exits into said air channel, wherein said outer hood has a smooth surface and said muffler assembly further comprises a corrugated sheet-metal part attached to said smooth surface, and wherein said corrugated sheet-metal part is tox clinched to said outer hood.

30. A muffler assembly for an internal combustion engine of a portable handheld work apparatus, the engine having a cylinder and an exhaust-gas stub and the muffler assembly comprising:

an exhaust-gas muffler having a muffler housing including first and second half shells connected substantially fluid tight to each other and said first and second halfshells conjointly defining an interior space;

said muffler housing further including a partition wall partitioning said interior space into first and second chambers;

a catalytic converter mounted in said partition wall;

an exhaust-gas inlet opening into said interior space and being connected to said exhaust-gas stub of said engine;

an exhaust-gas outlet for conducting exhaust gas out of said interior space;

said exhaust-gas muffler and said cylinder conjointly defining three attachment points, three threaded fasteners for fixing said exhaust-gas muffler on said cylinder at corresponding ones of said attachment points;

first and second one of attachment points being disposed in the region of said exhaust-gas stub;

said exhaust-gas muffler including an outer hood over said muffler housing and said outer hood and said muffler housing conjointly delimiting an air channel extending along one side of said exhaust-gas muffler; said air channel having a first end whereat an airflow enters and a second and whereat said airflow exits; and, said exhaust-gas muffler having said exhaust-gas outlet whereat the exhaust-gas jet exits into said air channel, wherein said outer hood includes a ramp at said second end of said air channel for deflecting a component flow of said exhaust gas, and wherein said ramp is formed by a sheet metal part connected to said outer hood.

* * * * *

UNITED STATES PATENT AND TRADEMARK OFFICE

CERTIFICATE OF CORRECTION

PATENT NO. : 6,955,043 B2 
DATED : October 18, 2005
INVENTOR(S) : Joerg Schlossarczyk, Georg Maier and Tommy Roitsch It is certified that error appears in the above-identified patent and that said Letters Patent is hereby corrected as shown below:

Column 2,
Lines 35 and 48, delete “aide” and substitute -- said --.
Line 42, delete “toned” and substitute -- formed --.

Column 8,
Line 51, delete “exhaust-gaps” and substitute -- exhaust-gas --.

Column 9,
Line 6, insert -- a -- before “portable”.
Lines 8 and 47, delete “comprising;” and substitute -- comprising: --.
Line 49, delete “including,” and substitute -- including --.
Line 54, delete “chambers” and substitute -- chambers; --.
Line 59, delete “exhaust-gas” and substitute -- exhaust gas --.
Line 62, delete “definite” and substitute -- defining --.

Column 10,
Line 12, insert -- said -- before “exhaust-”.
Line 27, delete “halfshells” and substitute -- half shells --.
Line 41, delete “points,” and substitute -- points; --.
Line 45, delete “one” and substitute -- ones --.
Line 53, delete the first “and” and substitute -- end --.

Signed and Sealed this

Twenty-third Day of May, 2006

JON W. DUDAS
*Director of the United States Patent and Trademark Office*